US007108441B2

(12) United States Patent
Altonen et al.

(10) Patent No.: US 7,108,441 B2
(45) Date of Patent: Sep. 19, 2006

(54) PACKAGE FOR DISPENSING A PRESSURIZED FLUID

(75) Inventors: Gene Michael Altonen, West Chester, OH (US); Benjamin J. Beck, Boston, MA (US); Laryssa Chortyk, Boston, MA (US); Douglas A. Marsden, Marblehead, MA (US); Scott Edward Smith, Cincinnati, OH (US); Ayub Ibrahim Khan, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/610,074

(22) Filed: Jun. 30, 2003

(65) Prior Publication Data

US 2004/0149778 A1 Aug. 5, 2004

Related U.S. Application Data

(60) Provisional application No. 60/392,096, filed on Jun. 28, 2002.

(51) Int. Cl.

| | |
|---|---|
| ***A46B 5/02*** | (2006.01) |
| ***B43K 5/12*** | (2006.01) |
| ***B65D 30/10*** | (2006.01) |

(52) U.S. Cl. ..... 401/190; 401/192; 220/9.1; 220/401

(58) Field of Classification Search ..... 401/183–186, 401/190, 192, 205; 220/9.1, 9.2, 9.3, 401, 220/402, 403; 222/635, 394, 402.1, 402.22
See application file for complete search history.

(56) References Cited

U.S. PATENT DOCUMENTS

| | | | | |
|---|---|---|---|---|
| 2,452,006 | A * | 10/1948 | Werner | 604/310 |
| 3,491,777 | A * | 1/1970 | Grosbard | 132/120 |
| 3,946,905 | A * | 3/1976 | Cogliano | 222/107 |
| 4,890,757 | A | 1/1990 | Robbins, III | |
| 6,179,142 | B1 | 1/2001 | Hansen | |
| 6,648,176 | B1 * | 11/2003 | Donovan | 222/107 |

FOREIGN PATENT DOCUMENTS

WO WO-00/44258 A2 8/2000

* cited by examiner

*Primary Examiner*—David J. Walczak
(74) *Attorney, Agent, or Firm*—Kenya T. Pierre; Vladimir Vitenberg; Andrew J. Hagerty

(57) ABSTRACT

A package for dispensing a pressurized fluid having a plastic container body comprising a non-round cross-section which is at least in part maintained by a skeletal support adjacent to the outer surface of the container body configured to do so.

18 Claims, 8 Drawing Sheets

PACKAGE FOR DISPENSING A PRESSURIZED FLUID

CROSS REFERENCE TO RELATED APPLICATION

This application claims the benefit under 35 USC 119(e) to U.S. application Ser. No. 60/392,096, filed Jun. 28, 2002.

TECHNICAL FIELD

The present invention relates to a package for dispensing a pressurized fluid and having a non-round cross-section for containing products such as antiperspirants and deodorants; and more particularly, to such a package including a skeletal support adjacent an outer surface of the non-round cross-section plastic container body.

BACKGROUND

The consumer products industry provides the world's consumers with a wide variety of products that are designed to meet consumer's needs. The number and variety of products that are available to today's consumers is vast and spans a broad range of functional design, aesthetic design, and intended use. These products can be grouped in numerous ways. For example, products can be grouped by function (cleansing, prevention, treatment, cosmetic enhancement, sensory experience, etc.), form (sprays, creams, lotions, wipes, bars, lathering soaps, etc.), and/or intended use (for hair, teeth, facial skin, legs, underarms, whole body). When considering the function, form and intended use, it is important to consider the package needed. Packages can be made of many materials such as plastic, glass composites and/or metal. Understanding the consumer desires, technical stability and mechanical robustness of the packaging material is necessary prior to expanding a product into the marketplace. Additional testing requirements will further drive the packaging material of choice.

Moreover, in attempting to provide the consumer with a reliable product such as an antiperspirant and/or deodorant, many consumers have few options available when it comes to the type of packaging such products are stored in or otherwise applied in use. Despite continuing efforts to bring an effectively packaged antiperspirant and/or deodorant to the consumer, packaging for certain pressurized products has remained unsatisfactorily limited by the conjunctive and often competing requirements of utility, convenience, cost and material characteristics. The present invention enables designs which provide the consumer with flexibility by providing a package which is lightweight, susceptible to use of a variety of materials and material characteristics, ergonomically designed, and permits the user to evaluate how much product remains in the package at any given time. The package generally includes a plastic container body of unique non-round shape and which comprises a cavity that houses a pressurized product, such as the antiperspirant and/or deodorant, and a skeletal support which serves to keep the container body having a non-round cross-section. This non-round cross-section provides for an ergonomic and aesthetically pleasing design allowing the user to more effectively and conveniently apply an antiperspirant and/or deodorant to the surface of the skin. The plastic container body can also be configured to have at least one substantially transparent portion so that the user of the product may easily determine how much product remains in the packaging at any given time. In addition, the packaging of the present invention can utilize various application arrangements such as an applicator surface or spray nozzle to allow the user to effectively coat the surface of their skin with products, such as an antiperspirant, cosmetic and/or deodorant.

SUMMARY OF THE INVENTION

According to one aspect of the present invention, a package is provided for dispensing a pressurized fluid to be applied to the body, such as an antiperspirant or deodorant.

According to another aspect of the present invention, a package is provided that maintains the shape of the non-round cross-section of the plastic container body storing a pressurized fluid.

In accordance with another aspect of the present invention, a package is provided where the plastic container body storing a pressurized fluid has a substantially transparent portion so that a user can determine how much of the pressurized fluid remains in the package. The transparent portion also allows the user to recognize and appreciate the fluid's characteristics (e.g., clear).

In yet another aspect of the present invention, a package is provided that can dispense a pressurized fluid in numerous manners, including specifically either through an applicator surface or spray nozzle.

According to another aspect of the present invention, a package is provided for dispensing a pressurized fluid such that an appropriate amount of dispensed fluid is uniformly and consistently applied.

In accordance with one or more of the above-described objects, the present invention provides for a package for dispensing a pressurized fluid that includes a plastic container body having a non-round cross-section and an outer surface, wherein the container body has a cavity for storing a pressurized fluid to be dispensed, and a skeletal support which is configured to substantially maintain the shape of the non-round cross-section of the container body and is adjacent to the outer surface of the container body. In one embodiment of the present invention, the container body has at least one substantially transparent portion. In particular, the transparent portion can serve to allow a user to determine the amount of pressurized fluid remaining in the package by permitting the user to see the level of the pressurized fluid when viewed. In another embodiment of the present invention, the package contains a dispensing actuator which permits a user to control the dispensing of a pressurized fluid. The dispensing actuator can operatively provide for such release of the pressurized fluid by various arrangements, such as through use of an applicator surface or spray nozzle. Moreover, the dispensing actuator allows a user to effectively and selectively use as much of the pressurized fluid, such as an antiperspirant or deodorant, as the user determines to be necessary in a consistent and controllable manner.

Still other advantages, applications and embodiments of the present invention will become apparent to those skilled in this art from the following description wherein there is shown and/or described several exemplary embodiments of this invention, by way of illustration, for carrying out the invention. As will be realized, the invention is capable of other different aspects, all without departing from the invention. Accordingly, the descriptions and drawings should be regarded as illustrative in nature and not restrictive.

All documents cited are, in relevant part, incorporated herein by reference; the citation of any document is not to be construed as an admission that it is prior art with respect to the present invention.

BRIEF DESCRIPTION OF THE DRAWINGS

While the specification concludes with claims which particularly point out and distinctly claim the present invention, it is believed that the present invention will be better understood from the following description of exemplary embodiments, taken in conjunction with the accompanying drawings, in which like reference numerals identify like elements throughout the views and wherein:

DETAILED DESCRIPTION OF THE EXEMPLARY EMBODIMENTS OF THE INVENTION

Figure 1:
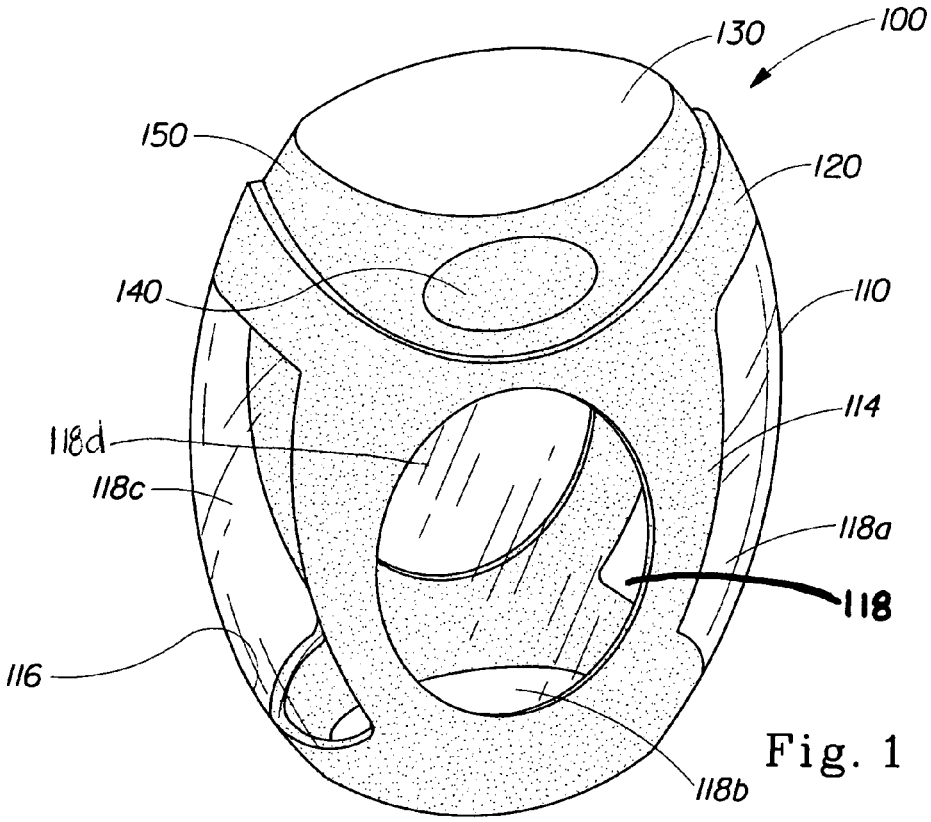
FIG. 1 is a perspective view of a package for dispensing a pressurized fluid made in accordance with the present invention and depicting a plastic container body having a skeletal support adjacent to its outer surface.

The present invention and its operation are hereinafter described in detail in connection with the views of FIGS. 1–9 illustrating various aspects of exemplary embodiments thereof. Like numbers indicate like elements among the corresponding views. In FIGS. 1–7, a package 100 for dispensing a pressurized fluid (e.g., 170) is illustrated as including a plastic container body 110 with a non-round cross-section (best seen in FIG. 4). A skeletal support 120 is provided adjacent to the outer surface 114 of the container body 110, and, as will be understood, helps to maintain the container body 110 in its non-round configuration in use and while filled with pressurized fluid 170.

Figure 1A:
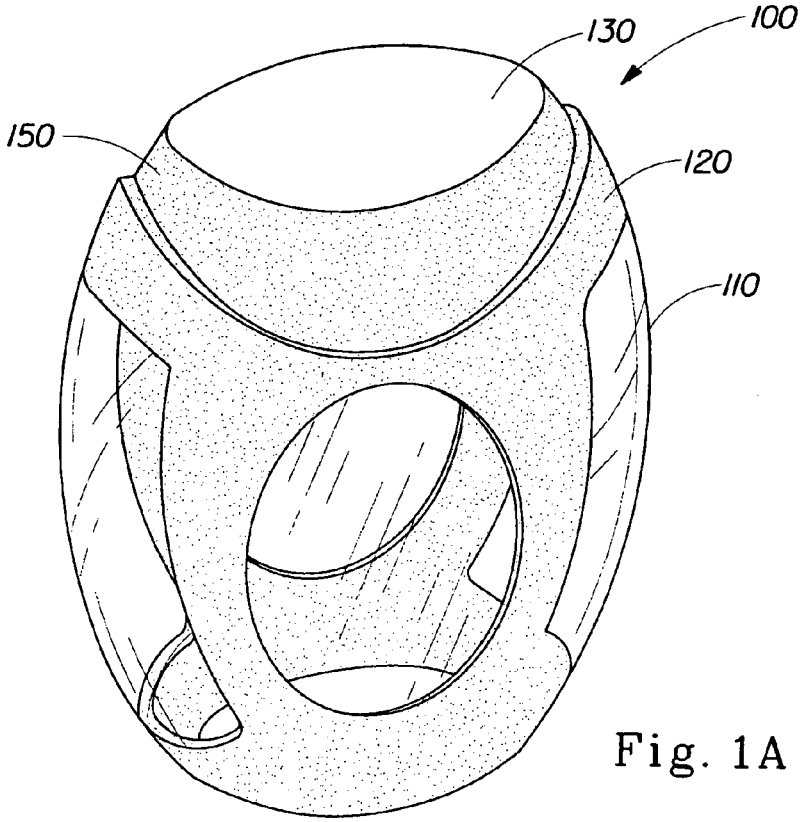
FIG. 1A illustrates the rear perspective view of the package of FIG. 1.
Figure 2:
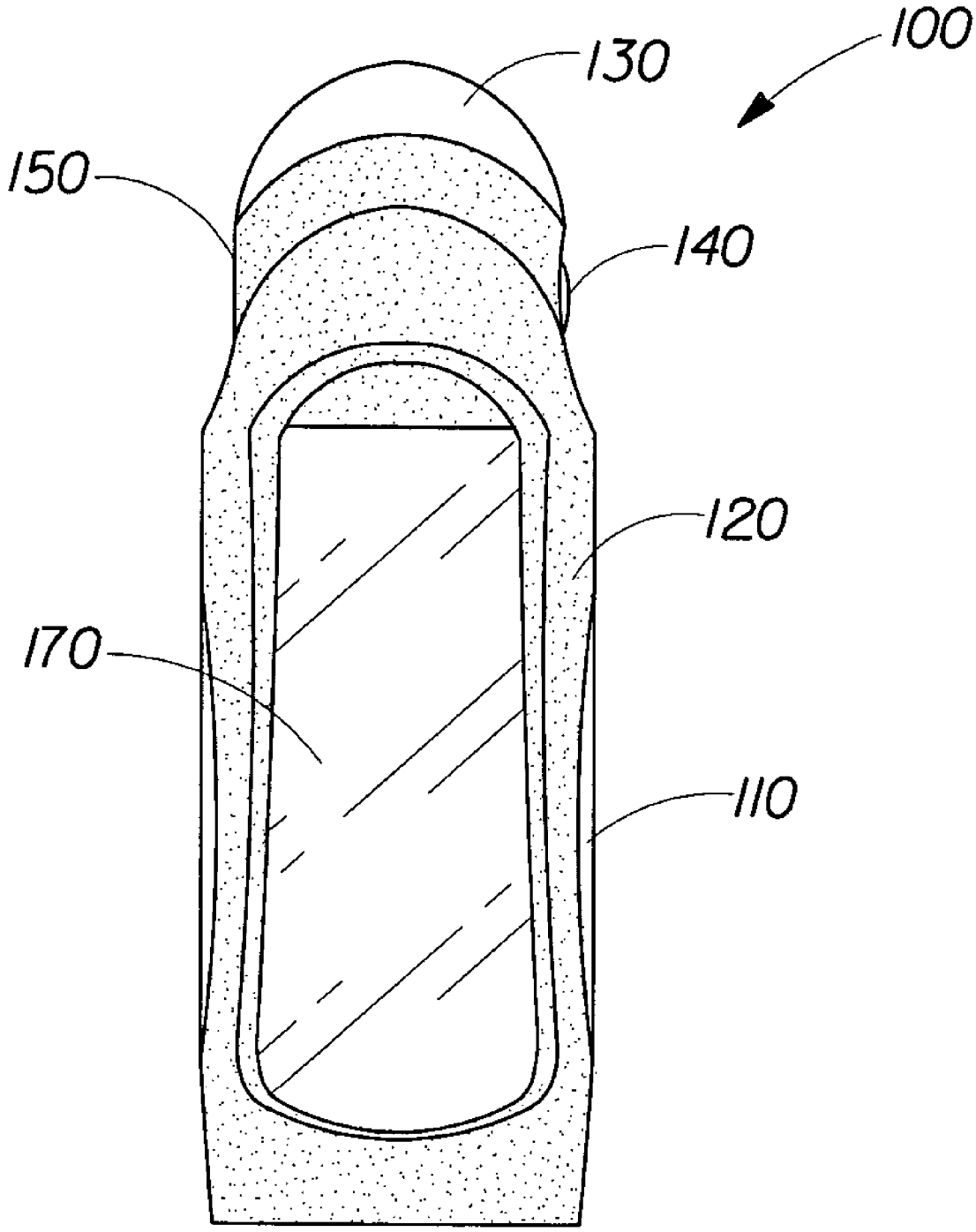
FIG. 2 is a side elevational view of the package of FIG. 1.
Figure 3:
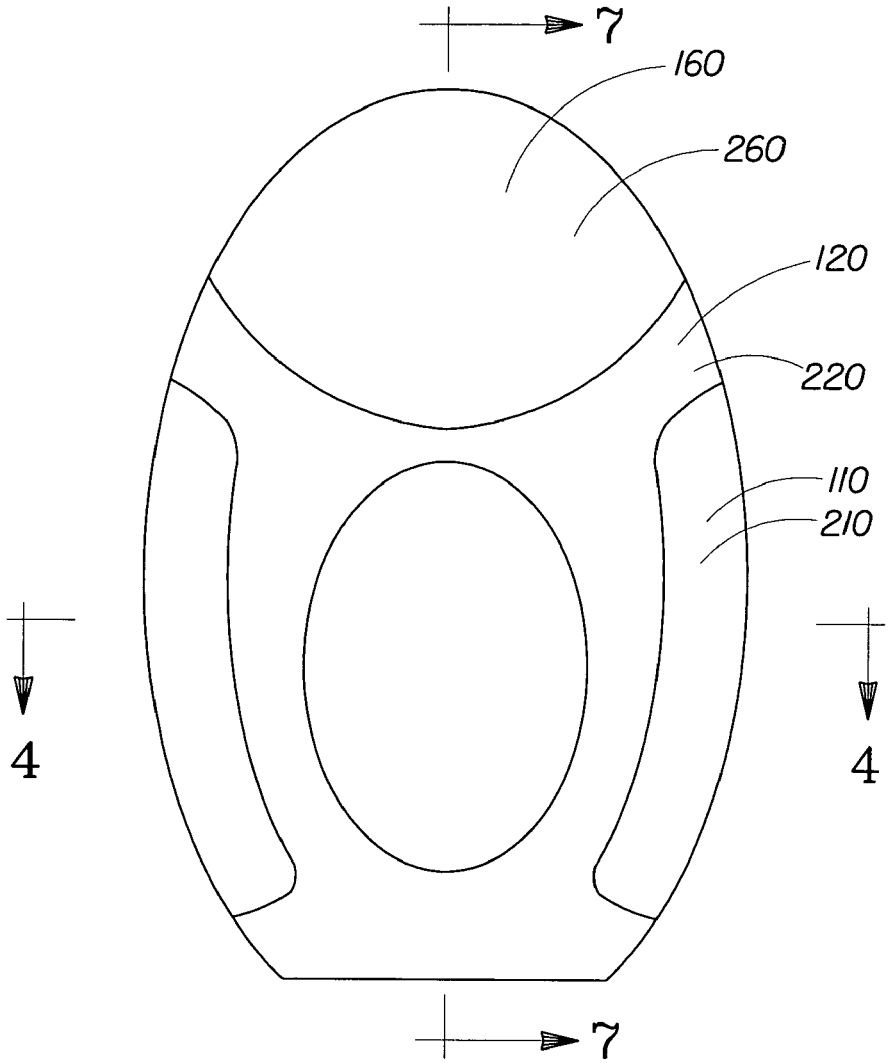
FIG. 3 is a front elevational view of the package of FIG. 1.

FIG. 1 depicts a perspective view of one embodiment of the package 100 for dispensing a pressurized fluid 170 of the present invention. As illustrated in the exemplary embodiment of FIG. 1, the plastic container body 110 is shown having one or more at least partially transparent portions 118 which permit(s) a user to easily visually determine the amount of pressurized fluid 170 remaining in the container body 110. Where a plurality of such at least partially transparent portions (e.g., 118*a*–*d*) are provided, the user can also peer through the container from various directions (e.g., front, back and sides) of the container body 110 as depicted in FIGS. 1, 1A and 2. The container body 110 can have at least one transparent portion 118 because of the composition of material used to form the container body 110. Particularly, the container body 110 can be made of a variety of materials including, but not limited to, polyolefins, polyesters, nylon, vinyl, acrylic, polycarbonates, polystyrene, polyeurothane, other known plastics, and/or mixtures thereof. More particularly, the container body 110 can be made from a polyamide resin, which provides adequate product containment and compatibility with pressurized fluid 170 and attendant propellants for pressurized products to be dispensed. Examples of such polyamide resin materials, propellants and the associated pressurized fluids 170, such as antiperspirants and/or deodorant materials, are more fully disclosed in U.S. patent application Ser. No. 10/146,697, entitled Pressurized Package Made of Polyamide Resin and Containing Dimethyl Ether, the disclosure of which is hereby incorporated herein by reference.

The container body 110 also defines an inner cavity 116, where the pressurized fluid 170 is stored until released or dispensed during use. As mentioned, the container body 110 is formed from a material having a composition chosen to adequately meet product and pressure demands exerted by the pressurized fluid 170 therewithin. For example, the container body would have to include at least a surface of the inner cavity 116 which was physically and chemically compatible with the pressure and pressurized product held therewithin so as to minimize degradation, failure, or other deleterious effects in use. One exemplary embodiment of a composition of the pressurized fluid 170 would include a single-phase, antiperspirant composition comprising solubilized antiperspirant active, a dimethylether propellant, and a low polarity solvent, as more fully disclosed in U.S. patent application Ser. No. 10/864,012, entitled Stable Pressurized Antiperspirant Compositions Containing Dimethylether Propellant and a Low Polarity Solvent, the disclosure of which is hereby incorporated herein by reference. Of course one skilled in the art can appreciate that the pressurized fluid 170 could comprise numerous other compositions, including a multi-phase, antiperspirant composition or the like. For example, the pressurized fluid 170 could comprise a solution that exists as a single phase, and upon release becomes two distinct phases.

Figure 4:
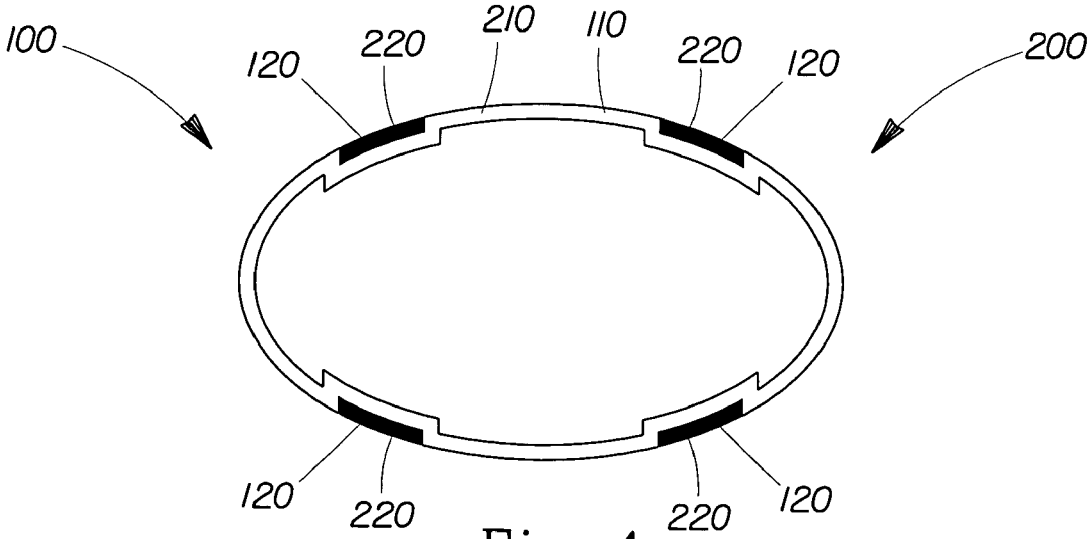
FIG. 4 is a cross-sectional view of the package of FIG. 3 taken along line 4—4 thereof.
Figure 6:
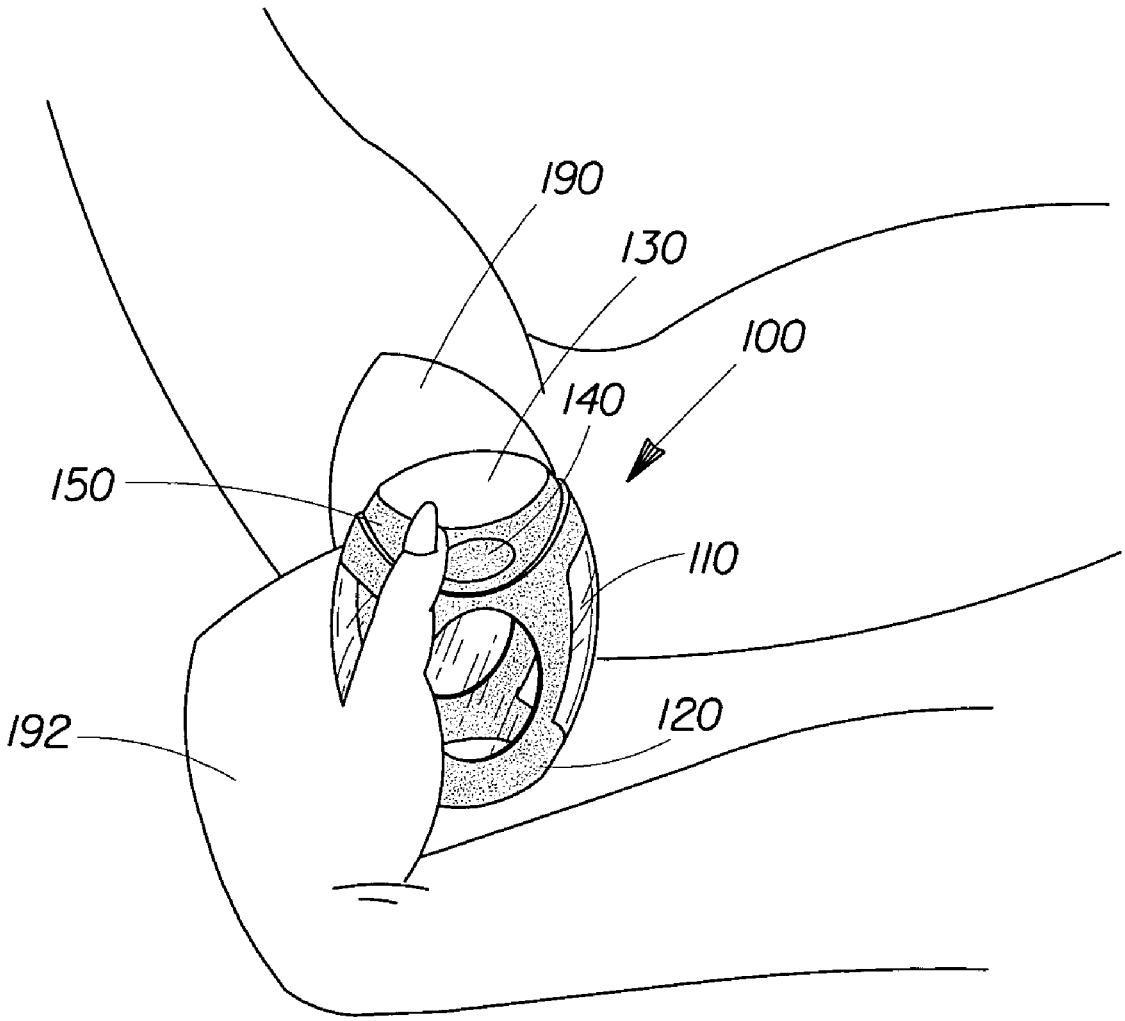
FIG. 6 is a partial perspective view illustrating application of product from a package made in accordance with the present invention and featuring an applicator surface.

While the entire container body 110 might be provided of clear material, in the embodiment shown in FIG. 1, the transparent portions 118 comprise at least the sections of the container body 110 not covered by the skeletal support 120. "Skeletal" as used in the present invention, envisions on at least partially open, cage or web-like design such that at least some of the container body 110 is not covered. The skeletal support 120 can be provided as a translucent or opaque structure distinguishing the container body 110 from the skeletal support 120, or could itself be at least partially transparent. The skeletal support 120 lies adjacent to the outer surface 114 of the container body 110 and is configured to conform closely enough to at least portions of body 110 so as to substantially maintain the shape of the non-round cross-section of the container body 110 in use. The non-round cross-section of the container body 110 is illustrated in FIGS. 1–4 as comprising a horizontal cross-section which runs substantially parallel to the area where the pressurized fluid 170 is dispensed and provided for use. More particularly, as best seen in FIG. 4, the non-round cross-section comprises a substantially oval cross-section. It should be kept in mind, however, that non-round cross-sections could be provided in many forms, sizes and shapes of containers. Generally, round cross-section containers can be made inexpensively and with sufficient strength to not need to take advantage of the support 120 of the present invention. For applications such as antiperspirant products and other products which desirably include non-round cross-sections to better conform to target product application surfaces, however, it is difficult to provide acceptable and lower cost containers without implementing the teachings of applicants invention herein. Consequently, maintaining this substantially oval cross-section is important, wherein it provides the consumer a more effective and efficient application surface by which to interact the package 100 with the surface of the skin, thereby better providing an effective amount of dispensed product, such as an antiperspirant and/or deodorant in a convenient and consistent manner to the required areas of the skin. Such utility is depicted in FIG. 6, which illustrates an exemplary use of the package 100 and its interaction with an underarm 190 of a user. As depicted in FIG. 6, the package is held adjacent to the underarm 190 by the user's hand 192. The user then presses a dispensing actuator 140 with a finger or thumb to cause the pressurized fluid 170 to be released and dispersed to an applicator surface 130 such that the released pressurized fluid 170 can be applied to the underarm 190 of the user.

The skeletal support 120 of FIGS. 1–4 has been configured to maintain the non-round cross-section of the container body 110. Such configuration is achieved through the size, shape, strength, and attachment of the skeletal support 120 and its close association with the container body 110. In one embodiment of the invention, for example, such synergistic configuration might be achieved by making the skeletal support 120 from materials having low creep and high tensile strength characteristics, relative to the material used to make the container body 110. Such materials could include any metal-loaded plastics and/or moldable metals (i.e., magnesium). Materials having low creep and high tensile strength provide an effective brace or containment barrier to the container body 110, preventing the container body 110 (or portions thereof) from permanently deforming and losing its non-round cross-section as a result of the internal pressure from the contained propellants which typically apply a uniform pressure against the interior surface of the container body causing the container body to become round in shape (i.e., a round shape is the most stable shape from an internal pressure perspective). Because it is desirable to make the wall of the container body 110 very thin, so that it comprises transparent portions 118, perhaps just as importantly, such design reduces the amount of material used, and hence the cost in producing the container body 110. Moreover, to enable the production of such a thin-walled container body 110, the importance and role of the skeletal support 120, which serves as an exoskeleton-like structure, greatly increases. This exoskeleton-like structure provides the needed support to minimize the potential for possible package 100 failures or deformations, which could result in leaks, lost product and an overall inconvenience to the user. For example, this exoskeleton-like structure can be designed to dampen impact and provide protection to the base and the shoulders of the container body 110, thereby increasing the structural integrity of the package 100. In another embodiment, for example, the exoskeleton-like structure can be designed to provide secondary protection to the container body 110 by having a higher glass transition temperature than the container body 110. The glass transition temperature is the temperature at which an amorphous material changes and such material can flow. Heat can allow the container body 110 to deform and stretch due to the force exerted by the pressurized fluid 170. By designing the exoskeleton-like structure with a material having a higher glass transition temperature than the material of the container body 110, additional protection and support is provided to the package 100 in high temperatures settings. Furthermore, to achieve a design that provides the consumer with such benefits, the exoskeleton-like structure is dependent upon a number of variables. Such variables may include the amount of pressure the container body 110 is under, the configuration of the container body 110 (i.e., the size, shape, wall thickness, composition) the ornamental appearance of the package 100, and the ergonomical arrangement of the package 100 to provide ease of use to the consumer. These variables, in addition to others, will influence how those skilled in the art will design the skeletal support 120 in providing the advantages set forth by the present invention.

In alternative embodiments, the skeletal support 120 could equally comprise other materials having characteristics other than low creep and high tensile strength, such as where the thickness of the skeletal support 120 is increased to prevent the deformation of the container body 110. It should also be appreciated that such design allows for the possibility that the skeletal support 120 might be made of the same material composition as the container body 110. In many applications and with respect to same relatively expensive materials (such as PET), it may be desirable, however, to provide a container body 110 as a thin walled, transparent bottle, while the skeletal support 120 is provided of less expensive materials (e.g., HDPE or PVC) of translucent or opaque characteristics. In this sense, one skilled in the art can understand that "different materials" sets forth a variance that can range from dissimilar compositions (i.e., ABS vs. HDPE) to the same or similar compositions having different tints, shades or colors (i.e., transparent PET vs. opaque PET). The principle idea is that the skeletal support, regardless of the material, makes the wall thickness greater at particular locations that may be weaker than other locations (actual location of weaker points is dependent upon the shape of the container body 110 and may be determined using industry standard methods such as finite element analysis).

Figure 5:
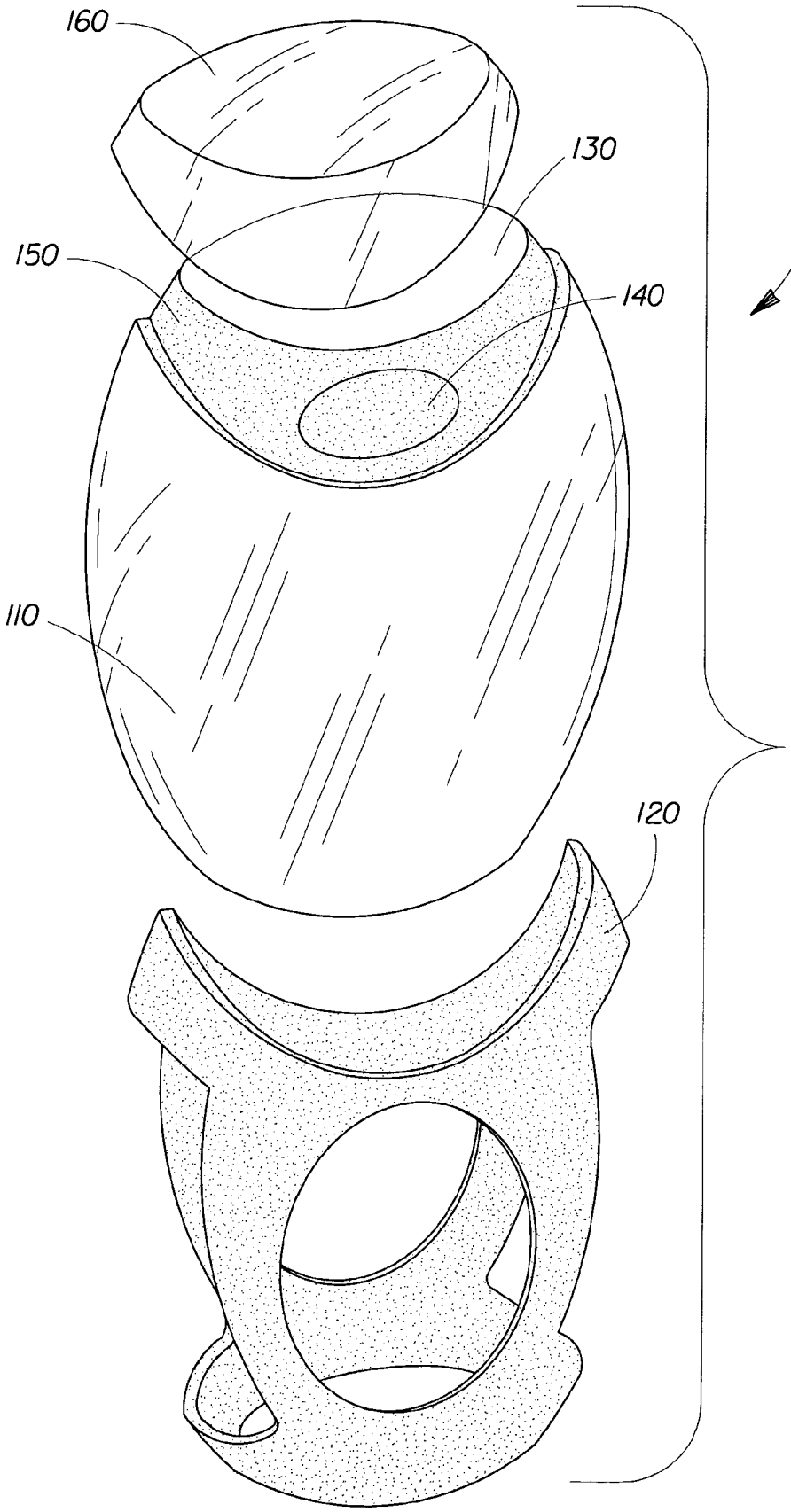
FIG. 5 is a partially exploded perspective view of the package of FIG. 1.

As depicted in FIG. 5, another exemplary embodiment of the present invention illustrates the skeletal support 120 comprising a substantially unitary structure, such that the entire skeletal support 120 comprises a single piece. In another embodiment, and further illustrated by the exploded view of FIG. 5, the container body 110 and skeletal support 120 might be provided as discrete components. Several methods exist in the art by which to combine such discrete components, but one exemplary method might include injection molding the skeletal support 120 around the container body 110 such that the skeletal support 120 was formed in-situ and closely adjacent to the outer surface 114 of the container body 110, while the container body 110 and skeletal support 120 remain discrete components. Another exemplary method would include blow molding the container body 110 inside of the already existing skeletal support 120, such that the skeletal support 120 is adjacent the outer surface 114 of the container body 110.

In another alternative embodiment, the container body 110 and skeletal support 120 might be integrally formed. As can be appreciated by those skilled in the art, the phrase "integrally formed" generally means that the skeletal support 120 and container body 110 are not discrete components. For example, if the skeletal support 120 is molded onto the container body 110 such that it cannot be easily physically removed then the skeletal support 120 has been integrally formed with the container body 110. Moreover, if the skeletal support 120 and the container body 110 are integrally attached by means of a bonding material (i.e., adhesive) or melted together (i.e., RF welding), then the skeletal support 120 and container body 110 are considered integrally formed. Similarly, if the skeletal support 120 and container body 110 are formed as a unitary structure, then they are integrally formed.

Figure 7:
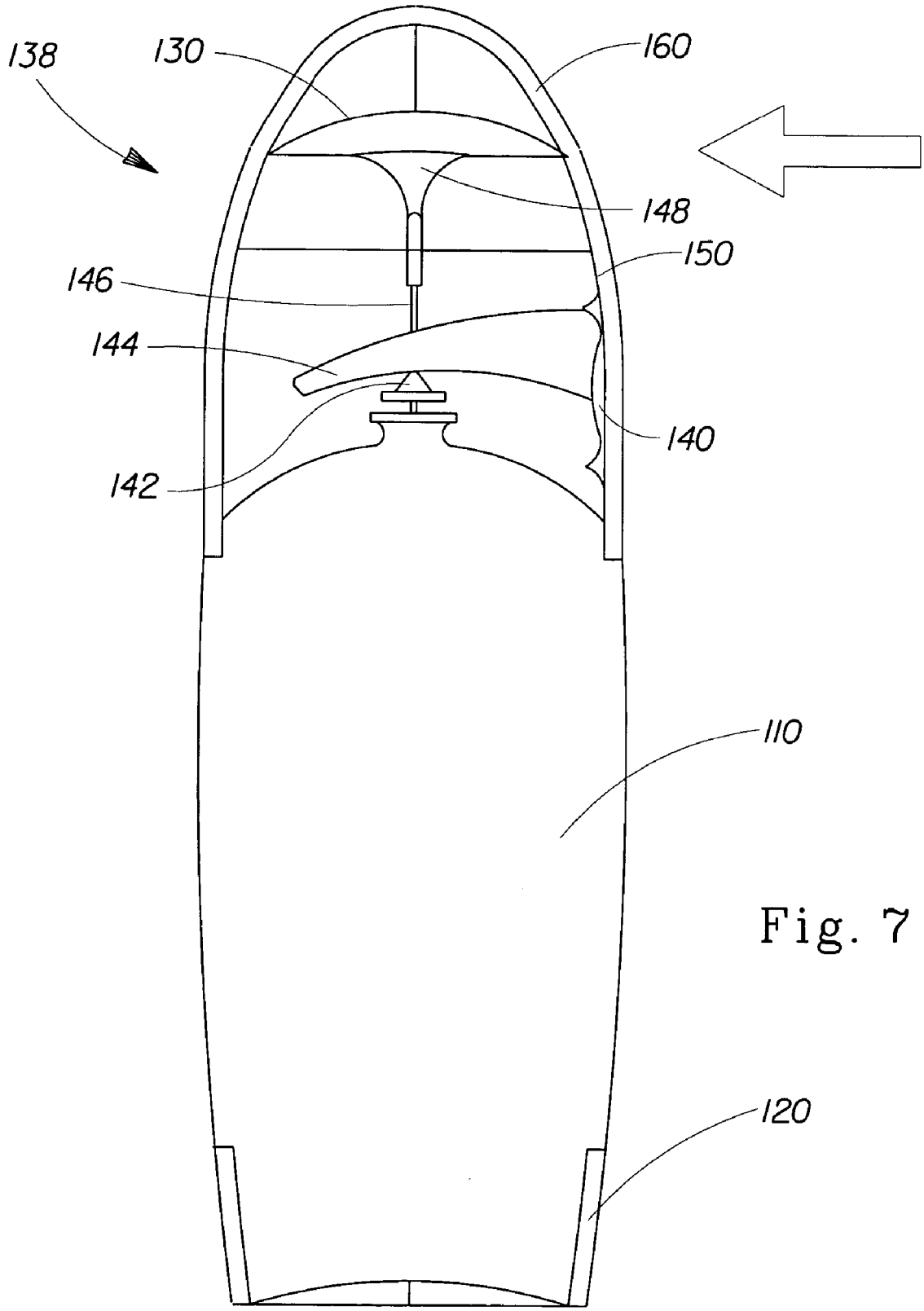
FIG. 7 is a vertical cross-sectional view of a package made in accordance with the present invention and illustrating an exemplary dispensing mechanism designed for the release of the pressurized fluid.

A still further embodiment of the present invention is shown in FIG. 7 and includes a package 100 that comprises a dispensing actuator 140 in combination with the plastic container body 110 and the skeletal support 120. FIG. 7 shows a cross-sectional view of a dispensing mechanism 138 in combination with the package 100 designed for the release of the pressurized fluid 170. A dispensing mechanism 138 is shown as comprising a dispensing actuator 140 which can be pushed inwardly by the user in order to cause material to be dispensed from the package 100. Such dispensing action can be provided in any of wide variety of manners, such as by causing a valve to move to an open position, causing a seal to be opened, or otherwise opening a fluid pathway for the pressurized material to escape. When released, the dispensing actuator 140 can then return to its predetermined off position, such as by the force of the pressurized material, or under the force of a spring or other biasing member. Although the dispensing actuator 140 is shown in this example as a button 140, other devices could be utilized for controlling the dispensing of the product, such as levers, rotary actuators and the like. The dispensing mechanism may further comprise an actuator cam 144, biasing valve 142, actuator stem 146, and a diffuser 148. The dispensing mechanism 138 primarily resides in a collar 150 of the package 100, which rests above the container body 110. The dispensing actuator 140 can be triggered while the user handles the package 100. For example, the dispensing actuator 140 may penetrate the collar 150 such that it can be operatively engaged by the user from the outside of the package 100. While FIG. 7 illustrates an exemplary embodiment, one skilled in the art can appreciate that numerous methods for actuating the release of the pressurized fluid 170 can be used.

In this example, upon engaging the dispensing actuator 140, the associated actuator cam 144 operatively moves a biasing valve 142 which provides access to the actuator stem 146 such that the pressurized fluid 170 can be released. As further illustrated in FIG. 7, in one embodiment of the present invention, a diffuser 148 can be provided beneath an applicator surface 130 so as to deliver the spray from the actuator stem 146 to substantially the entire inner surface of the applicator surface 130, when the applicator surface is placed adjacent the skin surface and the dispensing actuator 140 is operatively engaged. The applicator surface 130 might advantageously run across the upper surface of the collar 150 such that it can provide a natural flow to the shape of the package 100 and comprises an overall dome-like shape having a substantially non-round cross-section corresponding with the cross-section of the container body 110. In addition, the applicator surface 130 can comprise a convex curvature. Furthermore, the applicator surface 130 can be made from a variety of materials, such as porous (i.e., small apertures) and/or absorbent materials for instance, which allow pressurized fluid 170 to be delivered outwardly from the package 100 from beneath the applicator surface 130. This allows at least some of the diffused pressurized fluid 170 to be passed so as to touch the skin. The applicator surface 130 can also absorb at least some of the released pressurized fluid 170 to allow the pressurized fluid 170 to be provided at the outer surface of the applicator surface 130 and adjacent the skin, as depicted in FIG. 6, and to absorb any pressurized fluid 170 reflected back from the skin.

Turning briefly back to FIG. 5, packages of the present invention can also include an overcap (e.g. 160) which might selectively engage the skeletal support 120 such that the collar 150 and dispensing actuator 140 are effectively covered and/or rendered non-functional. In order to utilize such a package 100, a user would then have to remove the overcap 160 for application procedures; and once finished applying the desired amount of pressurized fluid 170, the user could replace the overcap 160 for storage and to prevent inadvertent release of additional pressurized fluid 170.

Figure 8:
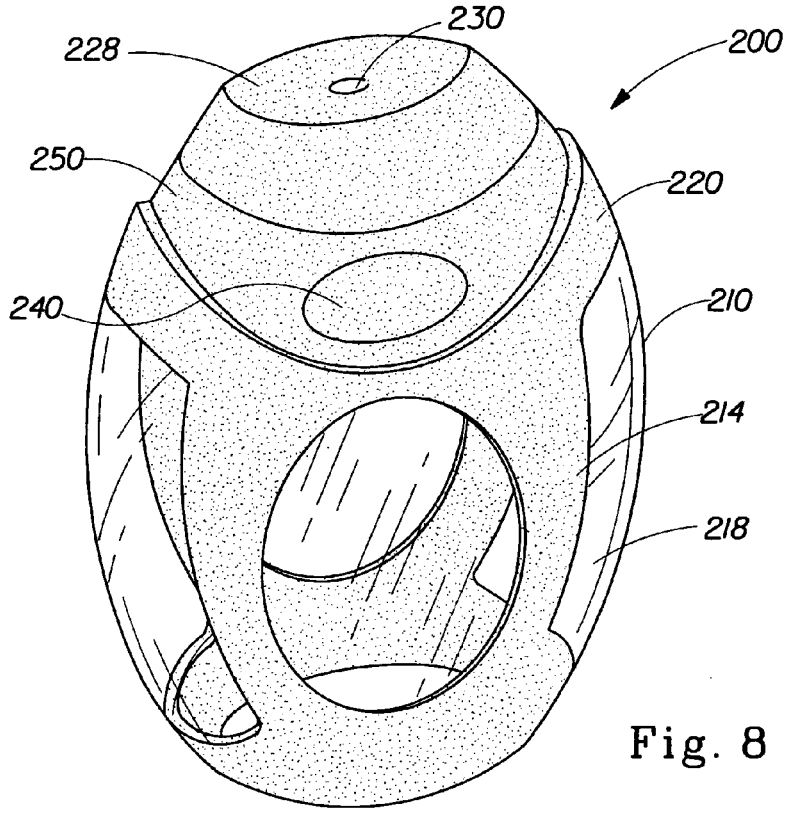
FIG. 8 is a perspective view similar to FIG. 1 illustrating an alternative embodiment of a package made in accordance with the present invention, and including a spray nozzle dispensing arrangement.
Figure 8A:
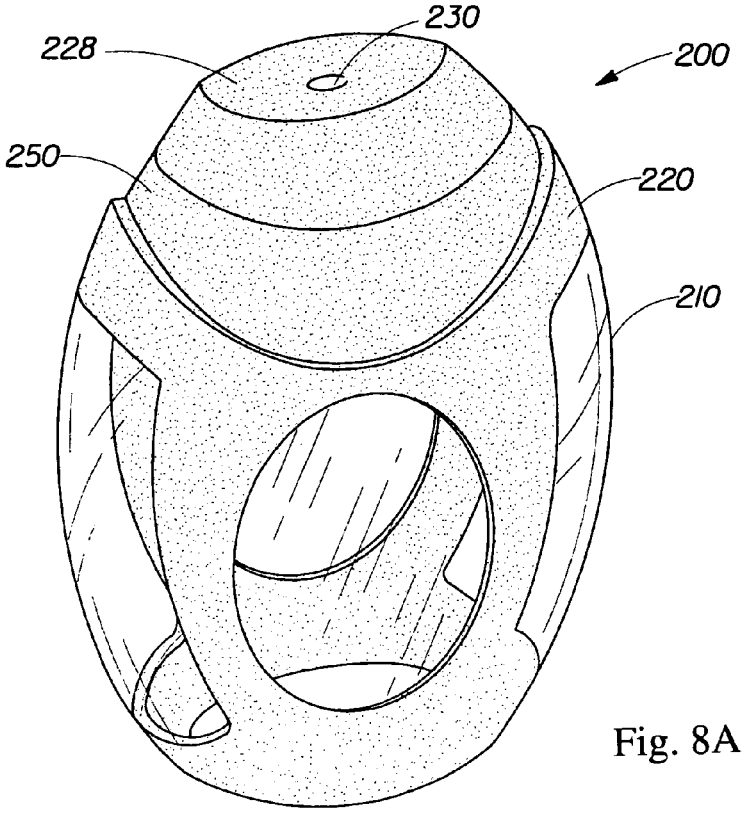
FIG. 8A illustrates the rear perspective view of the package of FIG. 8.

In an alternative embodiment of the present invention, the pressurized fluid 170 can be released by means of a spray nozzle 230 or other alternate dispensing arrangement as known or developed in the art. As depicted in the example of FIG. 8, all of the components previously shown with respect to the package 100 of FIG. 1, including a package 200 comprising a container body 210 having a skeletal support 220 adjacent to the outer surface 214 of the container body 210, wherein the container body 210 has at least one transparent portion 218, and an applicator surface 130, can be used in connection with a spray nozzle 230. In this example, the container body comprises the container body 210 along with the collar 250, and the applicator comprises a spray nozzle 230 positioned along a recessed region 228 in the collar 250. The spray nozzle 230 can comprise any suitable nozzle, opening, or dispensing device, with the desired shape or configuration for providing the appropriate spray pattern. The use of a spray nozzle 230 to dispense pressurized fluids 170 is well known in the art, and incorporating such a mechanism into the unique package 200 as defined by the present invention can be appreciated by those skilled in similar art.

Likewise, the recessed region 228 can be provided in a variety of shapes and sizes. In this example, the recessed region 228 comprises a concave or inwardly curved surface. However, the recessed surface could be provided as one or more other curved surfaces, such as saddle-shaped surfaces for example, one or more flat surfaces, or a combination of flat and curved surfaces, which extend inwardly from outer portions of the container body. As another example, the recessed surface could be provided by providing the container body with a cone or other hollow extension and including a surface within the extension at which the spray nozzle 230 can be located.

Figure 9:
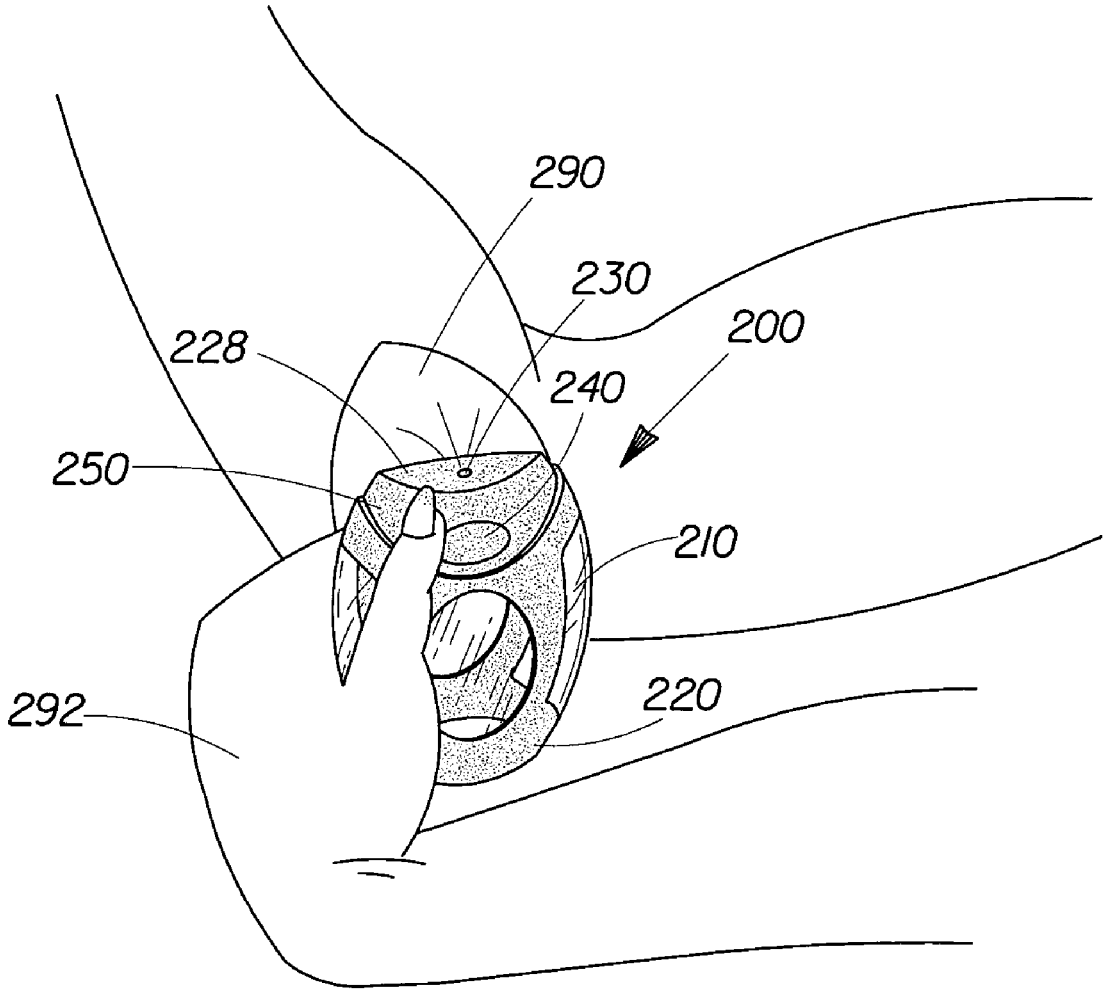
FIG. 9 is a partial perspective similar to FIG. 6 illustrating an application process using the package of FIG. 8.

In this arrangement, the spray nozzle 230 releases the pressurized fluid 170 as an aerosol such that the user positions the upper portion of the collar 250 in a manner that provides an ergonomic and comfortable feeling to the user's body surface just prior to dispensing the pressurized fluid 170 and applying it to the required areas of the skin as schematically demonstrated in FIG. 9. The example of FIG. 9 shows a distance can be maintained between the spray nozzle 230 and the surface of the skin to which the spray is to be applied. By maintaining this distance, it can be assured that the spray nozzle 230 is not placed too close to the skin during use, as such closeness between skin and nozzle can create poor application of the sprayed product, an undesirable sensory experience for the user, and/or the dripping of product down the skin and/or onto clothing. As depicted in FIG. 9, the package is held adjacent to the underarm 290 by the user's hand 292. The user then presses the dispensing actuator 240 with a finger or thumb to cause the pressurized fluid 170 to be released and dispersed to the spray nozzle 230 toward the underarm 290 of the user.

The foregoing description of various embodiments of the present invention has been presented for purposes of illustration and description. It is not intended to be exhaustive or to limit the invention to the forms described. Further modifications are possible in light of the above teachings and would be understood by those of ordinary skill. The embodiments were chosen and described in order to provide examples for illustrating the various principles and adaptability of the invention in various embodiments as are suited to exemplary uses contemplated. Consequently, it is hereby intended that the scope of the present invention is not to be limited to or by the exemplary embodiments shown and/or described herein, but are to be defined by the claims appended hereto.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

We claim:

1. A package for dispensing a pressurized fluid, said package comprising:

a plastic container body having a non-round cross-section and an outer surface, wherein said container body has a cavity storing pressurized fluid comprising a propellant to be dispensed;

a skeletal support adjacent to said outer surface and configured to substantially maintain the shape and prevent deformation and loss of said non-round cross-section of said container body as a result of internal pressure from said contained propellants; and a dispensing actuator.

2. A package according to claim 1, wherein said container body has at least one substantially transparent portion.

3. A package according to claim 1, wherein said container body has a substantially oval cross-section.

4. A package according to claim 1, wherein said container body is made substantially of a nylon material.

5. A package according to claim 1, wherein said skeletal support is substantially opaque.

6. A package according to claim 1, wherein said skeletal support is a substantially unitary structure.

7. A package according to claim 1, wherein said skeletal support comprises a composition having low creep and high tensile strength relative to said container body.

8. A package according to claim 1, wherein said skeletal support and said container body are made of different materials.

9. A package according to claim 1, wherein said skeletal support and said container body are discrete components.

10. A package according to claim 1, wherein said skeletal support and said container body are integrally formed.

11. A package according to claim 1, wherein said package further comprises an applicator surface.

12. A package according to claim 1, wherein said package further comprises a spray nozzle.

13. A package for dispensing a pressurized fluid, said package comprising:

a plastic container body having a non-round cross-section and an outer surface, wherein said container body has a cavity storing a pressurized fluid comprising a propellant to be dispensed, said container body having at least one substantially transparent portion;

a skeletal support adjacent to said outer surface and configured to substantially maintain the shape and prevent deformation and loss of said non-round cross-section of said container body as a result of internal pressure from said contained propellants; and a dispensing actuator.

14. A package according to claim 13, wherein said package further comprises an applicator surface.

15. A package according to claim 14, wherein said package further comprises a spray nozzle.

16. A pressurized fluid stored within a dispensing package comprising:

a plastic container body having a non-round cross-section and an outer surface, wherein said container body has a cavity;

a skeletal support adjacent to said outer surface and configured to maintain the shape and prevent deformation and loss of said non-round cross-section of said container body as a result of internal pressure from said contained propellants;

a pressurized fluid comprising a propellant stored within said container body; and a dispensing actuator.

17. A package according to claim 16, wherein said package further comprises an applicator surface.

18. A package according to claim 16, wherein said package further comprises a spray nozzle.

* * * * *